US011087673B2

(12) United States Patent
Su et al.

(10) Patent No.: US 11,087,673 B2
(45) Date of Patent: Aug. 10, 2021

(54) IMAGE APPARATUS AND A METHOD OF PREVENTING BURN IN

(71) Applicant: Novatek Microelectronics Corp., Hsinchu (TW)

(72) Inventors: Shang-Yu Su, New Taipei (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/458,199

(22) Filed: Jul. 1, 2019

(65) Prior Publication Data

US 2020/0211453 A1 Jul. 2, 2020

Related U.S. Application Data

(60) Provisional application No. 62/785,230, filed on Dec. 27, 2018.

(51) Int. Cl.
*G09G 3/3208* (2016.01)
*G09G 3/20* (2006.01)

(52) U.S. Cl.
CPC ..... *G09G 3/3208* (2013.01); *G09G 3/2003* (2013.01); *G09G 2320/046* (2013.01); *G09G 2340/06* (2013.01)

(58) Field of Classification Search
CPC ..... G09G 3/3611; G09G 2320/041; G09G 2340/16; G09G 2320/0252; G09G 3/3208; G09G 3/2003; G09G 2320/046; G09G 2340/06
See application file for complete search history.

(56) References Cited

U.S. PATENT DOCUMENTS 10,706,754 B2 * 7/2020 Jaffari ..... G09G 3/006
2008/0231624 A1 * 9/2008 Poon ..... G09G 3/3611 345/212
2009/0256791 A1 * 10/2009 Wang ..... G09G 3/3611 345/89
2013/0194199 A1 * 8/2013 Lynch ..... G06F 3/0421 345/173
2014/0192037 A1 * 7/2014 Chung ..... G09G 3/2022 345/212
2015/0170612 A1 * 6/2015 Muguruma ..... G09G 3/3283 345/690

(Continued)

*Primary Examiner* — Vinh T Lam
(74) *Attorney, Agent, or Firm* — JCIPRNET

(57) ABSTRACT

An image apparatus and a method of preventing burn in are provided. The image apparatus includes a comparison circuit, a stress level circuit and an image processing circuit. The comparison circuit compares a difference between a current block in a current frame and the current block in a previous frame to obtain difference information corresponding to the difference, wherein the current block includes at least one pixel. The stress level circuit is coupled to the comparison circuit to receive the difference information corresponding to the current block of the current frame, and estimates a stress status of the current block of the current frame according to the difference information. The image processing circuit is coupled to the stress level circuit to receive the stress status, and determines whether to downgrade a stress of the current block according to the stress status to prevent occurrence of burn in.

46 Claims, 5 Drawing Sheets

(56) References Cited

U.S. PATENT DOCUMENTS

| | | | | |
|---|---|---|---|---|
| 2016/0019842 | A1* | 1/2016 | Kim | G09G 3/3291 345/694 |
| 2016/0027404 | A1* | 1/2016 | Nakanishi | G09G 3/2074 345/590 |
| 2016/0140895 | A1* | 5/2016 | Park | G09G 3/3208 345/690 |
| 2017/0070681 | A1* | 3/2017 | Nattress | G06T 9/00 |
| 2018/0012563 | A1* | 1/2018 | Lee | G09G 5/10 |
| 2018/0075798 | A1* | 3/2018 | Nho | G09G 3/32 |
| 2019/0130846 | A1* | 5/2019 | Chung | G09G 3/3266 |
| 2019/0139478 | A1* | 5/2019 | Jang | G09G 3/3225 |
| 2019/0164486 | A1* | 5/2019 | An | G09G 3/3275 |
| 2019/0287454 | A1* | 9/2019 | Cook | G09G 3/3208 |
| 2020/0152119 | A1* | 5/2020 | Xuan | G09G 3/3233 |

* cited by examiner

| | | | |
|---|---|---|---|
| 0 | 0 | 0 | 0 |
| 0 | 1 | 0 | 0 |
| 0 | 2 | 0 | 0 |
| 0 | 0 | 0 | 0 |
| 0 | 0 | 0 | 0 |

| | | | |
|---|---|---|---|
| 0 | 0 | 0 | 0 |
| 0 | 16 | 0 | 0 |
| 0 | 32 | 0 | 0 |
| 0 | 0 | 0 | 0 |
| 0 | 0 | 0 | 0 |

| | | | |
|---|---|---|---|
| 1 | 1 | 1 | 0 |
| 1 | 8 | 1 | 0 |
| 1 | 16 | 1 | 0 |
| 1 | 1 | 1 | 0 |
| 0 | 0 | 0 | 0 |

FIG. 6

IMAGE APPARATUS AND A METHOD OF PREVENTING BURN IN

CROSS-REFERENCE TO RELATED APPLICATION

This application claims the priority benefit of U.S. provisional application Ser. No. 62/785,230, filed on Dec. 27, 2018. The entirety of the above-mentioned patent application is hereby incorporated by reference herein and made a part of this specification.

BACKGROUND

Field of the Invention

The invention relates to a display apparatus and more particularly, to an image apparatus and a method of preventing burn in.

Description of Related Art

An organic light-emitting diode (OLED) display panel is a self-luminous display panel. Due to panel manufacturing factors (such as a manufacturing process, materials and so on) and environment factors (such as temperature, humidity and so on), each pixel of the OLED panel may be decayed inconsistently, which causes a burn in phenomenon. How to prevent occurrence of burn in is a technical subject of this field.

It should be noted that the contents of the section of "Description of Related Art" is used for facilitating the understanding of the invention. A part of the contents (or all of the contents) disclosed in the section of "Description of Related Art" may not pertain to the conventional technology known to the persons with ordinary skilled in the art. The contents disclosed in the section of "Description of Related Art" do not represent that the contents have been known to the persons with ordinary skilled in the art prior to the filing of this invention application.

SUMMARY

The invention provides an image apparatus and a method of preventing burn in thereof to effectively reduce an occurrence probability of bur in.

According to an embodiment of the invention, an image apparatus is provided. The image apparatus includes a comparison circuit, a stress level circuit and an image processing circuit. The comparison circuit is configured to compare a difference between a current block in a current frame and the current block in a previous frame to obtain difference information corresponding to the difference, wherein the current block includes at least one pixel. The stress level circuit is coupled to the comparison circuit to receive the difference information corresponding to the current block of the current frame. The stress level circuit is configured to estimate a stress status of the current block of the current frame according to the difference information. The image processing circuit is coupled to the stress level circuit to receive the stress status. The image processing circuit is configured to determine whether to downgrade a stress of the current block according to the stress status to prevent occurrence of burn in.

According to an embodiment of the invention, a method of preventing burn in is provided. The method of preventing burn in includes: comparing a difference between a current block in a current frame and the current block in a previous frame by a comparison circuit to obtain difference information corresponding to the difference, wherein the current block includes at least one pixel; estimating a stress status of the current block of the current frame according to the difference information by a stress level circuit; and determining whether to downgrade a stress of the current block according to the stress status by an image processing circuit to prevent occurrence of burn in.

To sum up, the image apparatus and the method of preventing burn in thereof provided by the embodiments of the invention can compare the difference between the current block in the current frame and the current block in the previous frame. The image apparatus can estimate the stress status of the current block of the current frame according to the difference, so as to determine whether to downgrade the stress of the current block according to the stress status. Thus, the image apparatus and the method of preventing burn in thereof can effectively reduce the occurrence probability of bur in.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 6 is a schematic diagram illustrating a specific example of the stress levels adjusted for different blocks by diffusion.

DESCRIPTION OF EMBODIMENTS

Figure 1:
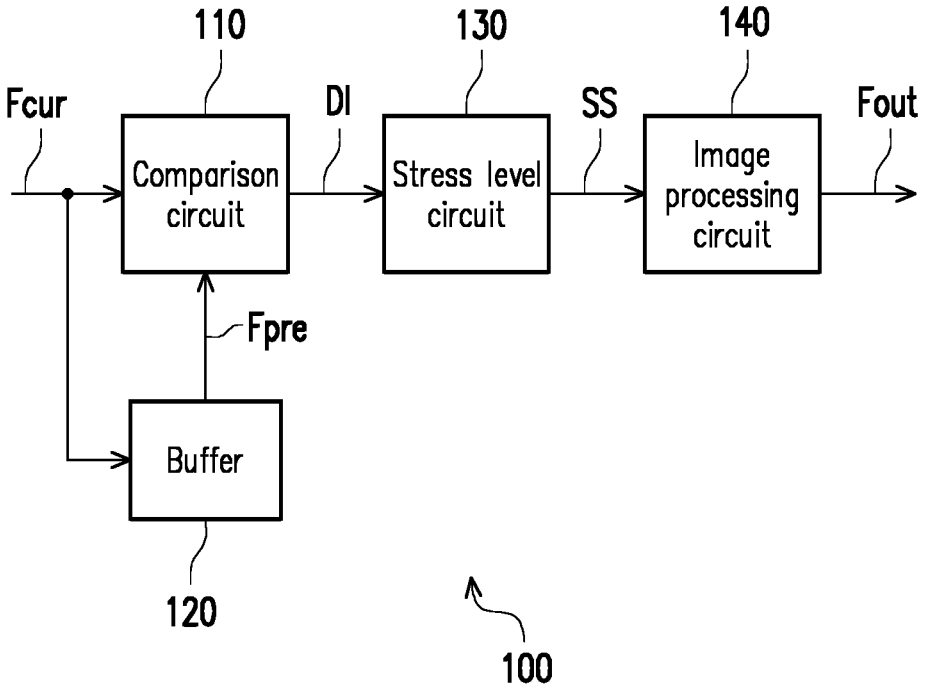
FIG. 1 is a schematic circuit block diagram illustrating an image apparatus according to an embodiment of the invention.

The term "couple (or connect)" throughout the specification (including the claims) of this application are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. In addition, terms such as "first" and "second" mentioned throughout the specification (including the claims) of this application are only for naming the names of the elements or distinguishing different embodiments or scopes and are not intended to limit the upper limit or the lower limit of the number of the elements not intended to limit sequences of the elements. Moreover, elements/components/steps with same reference numerals represent same or similar parts in the drawings and embodiments. Elements/components/notations with the same reference numerals in different embodiments may be referenced to the related description.

In order to prevent burn in from occurring to an organic light-emitting diode (OLED) panel and to extend a lifetime of pixels, the disclosure provides an image apparatus and a method of preventing burn thereof. It should be noted that the disclosure is not limited to be applied only to the OLED panel, and the technique of the disclosure may be applied to other display panels, such as a liquid-crystal display (LCD) panel, a light-emitting diode (LED) display panel, a mini-LED display panel, a micro-LED display panel, an electronic paper, an plasma display and so on.

FIG. 1 is a schematic circuit block diagram illustrating an image apparatus 100 according to an embodiment of the invention. The image apparatus 100 includes a comparison circuit 110, a buffer 120, a stress level circuit 130 and an image processing circuit 140. A current frame Fcur illustrated in FIG. 1 may be divided into one or more blocks according to a design requirement. For instance, in some embodiments, the current frame Fcur may be entirely divided into one block (i.e., a current block). In some other embodiments, the current frame Fcur may be divided into a plurality of blocks in a 1-dimension or a 2-dimension manner, and one of the blocks is the current block. The current block includes at least one pixel. The comparison circuit 110 is coupled to the buffer 120. The buffer 120 may receive and temporarily store the current block of the current frame Fcur and provide the current block in a previous frame Fpre to the comparison circuit 110. Color spaces of the current frame Fcur and the previous frame Fpre are not limited in the present embodiment. For example, the color spaces of the current frame Fcur may include RGB, XYZ, xyY, HSV, YUV, YCbCr, Lab or other color spaces.

Figure 2:
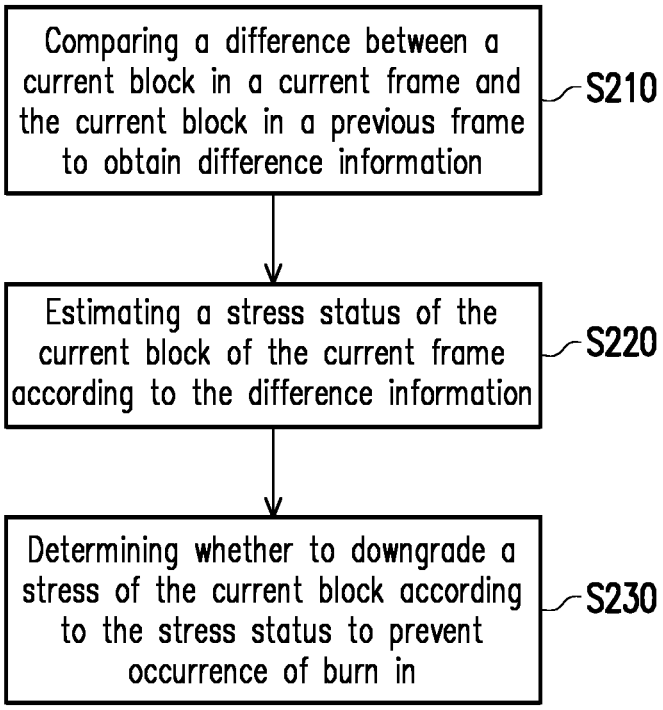
FIG. 2 is a flowchart illustrating a method of preventing burn in according to an embodiment of the invention.

FIG. 2 is a flowchart illustrating a method of preventing burn in according to an embodiment of the invention. Referring to FIG. 1 and FIG. 2, in step S210, the comparison circuit 110 may compare a difference between the current block in the current frame Fcur and the current block in the previous frame Fpre to obtain difference information DI corresponding to the difference. In other embodiments, the comparison circuit 110 may compare the difference between the current block in the current frame and the current block in each of a plurality of previous frames.

For example, the comparison circuit 110 may calculate an average value (or a weighted average value, which is referred to as a first average value hereinafter) of a plurality of sub-pixels in the current block of the current frame Fcur and an average value (or a weighted average value, which is referred to as a second average value hereinafter) of a plurality of sub-pixels in the current block of the previous frame Fpre. The physical properties of the first average value and the second average value are not limited in the present embodiment. For instance, in some embodiments, the first average value may be a brightness average value (or a weighted average value) of the plurality of sub-pixels in the current block of the current frame Fcur, and the second average value may be a brightness average value (or a weighted average value) of the plurality of sub-pixels in the current block of the previous frame Fpre. The comparison circuit 110 may calculate a difference value between the first average value and the second average value. The comparison circuit 110 may obtain the difference information DI corresponding to the difference between the current block in the current frame Fcur and the current block in the previous frame Fpre according to the difference value.

The implementation details related to "obtaining the difference information DI according to the difference value between the first average value and the second average value" are not limited in the present embodiment. For instance, in some embodiments, the comparison circuit 110 may obtain a first count value by comparing the difference value with at least one difference threshold value, and the comparison circuit 110 may calculate the difference information DI corresponding to the current block of the current frame Fcur by using the first count value. The operation details related to "obtaining the first count value by comparing the difference value with the difference threshold value" may be determined according to a design requirement. For instance, in some embodiments, when the difference value is less than or equal to the difference threshold value, the comparison circuit 110 may increase the first count value. When the difference value is greater than or equal to the difference threshold value, the comparison circuit 110 may decrease (clear) the first count value. The difference threshold value may be determined according to a design requirement. According to a design requirement, the comparison circuit 110 may output the first count value to the stress level circuit 130 to serve as the difference information DI.

As another example, in some other embodiments, the at least one difference threshold value includes a first difference threshold value and a second difference threshold value, wherein the first difference threshold value is less than the second difference threshold value, and the first value and the second value and the second difference threshold value may be determined according to a design requirement. When a difference value between the first average value and the second average value is less than or equal to the first difference threshold value, the comparison circuit 110 may increase the first count value. When the difference value is greater than or equal to the second difference threshold value, the comparison circuit 110 may decrease (clear) the first count value.

The operation details (step S210) related to the comparison circuit 110 should not be limited to the aforementioned examples. In another embodiment, the comparison circuit 110 may further receive a temperature value. The comparison circuit 110 may generate the difference information DI according to the temperature value and the difference between the current block in the current frame Fcur and the current block in the previous frame Fpre. For example, the comparison circuit 110 may obtain the first count value by comparing the difference value between the first average value and the second average value with the at least one difference threshold value, and the comparison circuit 110 may obtain the difference information DI corresponding to the difference between the current block in the current frame Fcur and the current block in the previous frame Fpre according to the first count value and the temperature value. Alternatively, the comparison circuit 110 may obtain a second count value by comparing the temperature value with a temperature threshold value, and the comparison circuit 110 may calculate the difference information DI corresponding to the current block of the current frame Fcur by using the first count value and the second count value. The operation details related to "obtaining the second count value" are not limited in the present embodiment. For instance, in some embodiments, when the temperature value is greater than or equal to the temperature threshold value, the comparison circuit 110 may increase the second count value. The temperature threshold value may be determined according to a design requirement.

In the same or yet another embodiment, the comparison circuit 110 may further receive a humidity value. In other words, the comparison circuit 110 may further receive at least one of a temperature value and a humidity value. In one embodiment, the comparison circuit 110 may generate the difference information DI according to the humidity value and the difference between the current block in the current frame Fcur and the current block in the previous frame Fpre. In some other embodiments, the comparison circuit 110 may generate the difference information DI according to at least one of the temperature value and the humidity value and the difference between the current block in the current frame Fcur and the current block in the previous frame Fpre. In some embodiments, the comparison circuit 110 may obtain the first count value by comparing the difference value between the first average value and the second average value with the at least one difference threshold value, and the comparison circuit 110 may obtain the difference information DI corresponding to the difference between the current block in the current frame Fcur and the current block in the previous frame Fpre according to the first count value and the humidity value. Alternatively, the comparison circuit 110 may obtain the second count value by comparing the humidity value with a humidity threshold value, and the comparison circuit 110 may calculate the difference information DI corresponding to the current block of the current frame Fcur by using the first count value and the second count value. The operation details related to "obtaining the second count value" are not limited in the present embodiment. For instance, in some embodiments, when the humidity value is greater than or equal to the humidity threshold value, the comparison circuit 110 may increase the second count value. The humidity threshold value may be determined according to a design requirement.

The comparison circuit 110 may generate the difference information DI according to the first count value and the second count value to provide to the stress level circuit 130. For example, the comparison circuit 110 may calculate a sum value (or a weighted sum value) of the first count value and the second count value and output the sum value (or the weighted sum value) to the stress level circuit 130 to serve as the difference information DI. In other embodiments, the comparison circuit 110 may calculate an average value (or a weighted average value) of the first count value and the second count value and output the average value (or the weighted average value) to the stress level circuit 130 to serve as the difference information DI.

The stress level circuit 130 is coupled to the comparison circuit 110 to receive the difference information DI corresponding to the current block of the current frame Fcur. In step S220, the stress level circuit 130 may estimate a stress status SS of the current block of the current frame Fcur according to the difference information DI. For example (but not limited to), the stress level circuit 130 may determine a stress level of the current block of the current frame Fcur according to the difference information DI, the stress level circuit 130 may adjust a stress value of the current block of the current frame Fcur according to the stress level, and the stress level circuit 130 may serve the stress value as the stress status SS to provide to the image processing circuit 140. Examples of specific operations of the comparison circuit 110 and the stress level circuit 130 are illustrated with reference to FIG. 3, FIG. 4 and FIG. 5.

Figures 3, 4, 5:
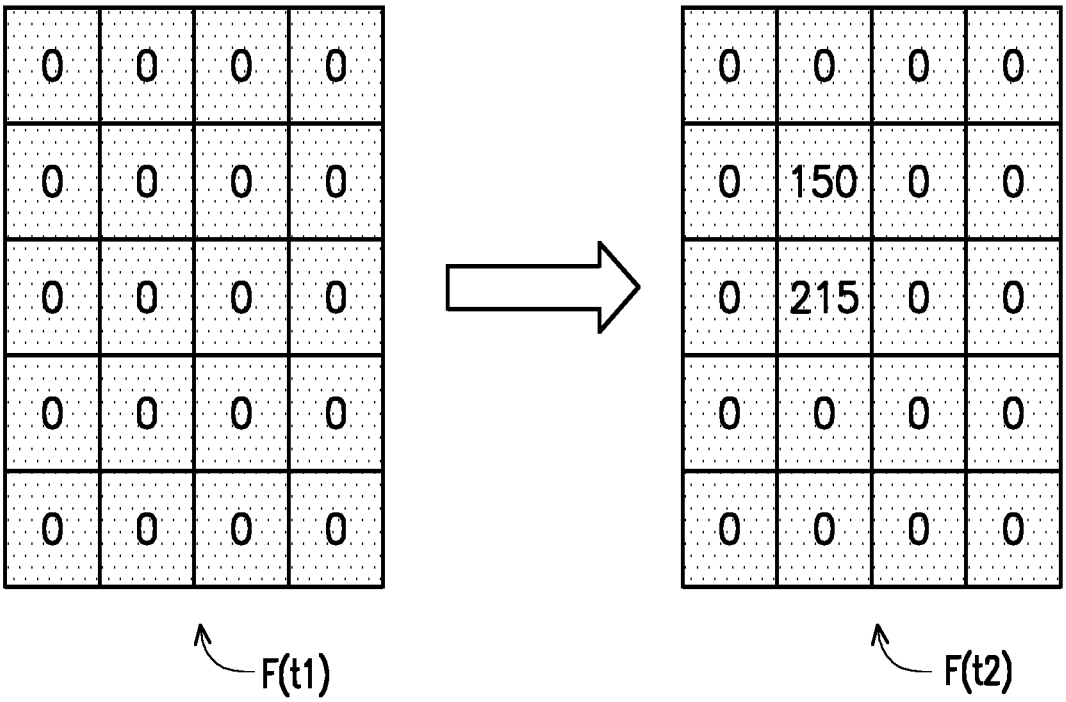
FIG. 3 is a schematic diagram illustrating a specific example that the difference information is changed with the comparing operation of the comparison circuit.
FIG. 4 is a schematic diagram illustrating a specific example of the stress levels determined for different blocks by the stress level circuit.
FIG. 5 is a schematic diagram illustrating a specific example of the stress levels adjusted for different blocks by the stress level circuit.

FIG. 3 is a schematic diagram illustrating a specific example that the difference information DI is changed with the comparing operation of the comparison circuit 110. As described in detail above, the comparison circuit 110 may compare the difference between the current block in the current frame Fcur and the current block in the previous frame Fpre to obtain the difference information DI (e.g., a count value) corresponding to the difference. F(t1) illustrated in FIG. 3 represents the current frame Fcur at a time point tl. It is assumed herein that the difference information DI (e.g., the count value) of all blocks of the frame F(t1) (the current frame Fcur at the time point tl) is initialized to an initial value of "0".

F(t2) illustrated in FIG. 3 represents the current frame Fcur at a time point t2. It is assumed that during a period from the time point t1 to the time point t2, the difference information DI (e.g., the count value) of the block of the second row and the second column is changed from "0" to "150", and the difference information DI (e.g., the count value) of the block of the third row and the second column is changed from "0" to "215". The stress level circuit 130 may determine the stress level of the current block of the current frame Fcur according to the difference information DI.

FIG. 4 is a schematic diagram illustrating a specific example of the stress levels determined for different blocks by the stress level circuit 130. It is assumed that a plurality of stage threshold values are defined by the stress level circuit 130, which include stage threshold values of "100" and "200". The stage threshold values are determined according to a design requirement. FIG. 3 illustrates that in the current frame F(t2) at the time point t2, and the difference information DI (e.g., the count values) of a plurality of blocks are all "0", and because the difference information DI (e.g., the count values) of "0" of these blocks are less than the stage threshold value of "100", the stress levels of these blocks are determined to be "0" (as illustrated in FIG. 4). For the block of the second row and the second column, its difference information DI (e.g., the count value) of "150" is between the stage threshold value of "100" and the stage threshold value of "200", the stress level of this block is determined to be "1" (as illustrated in FIG. 4). For the block of the third row and the second column, and because the difference information DI (e.g., the count values) of "215" is greater than the stage threshold value of "200", the stress level of this block is determined to be "2" (as illustrated in FIG. 4). The stress level circuit 130 may adjust the stress value of the current block of the current frame Fcur according to the stress level as illustrated in FIG. 4, and the stress level circuit 130 may serve this stress value as the stress status SS to provide to the image processing circuit 140.

FIG. 5 is a schematic diagram illustrating a specific example of the stress levels adjusted for different blocks by the stress level circuit 130. According to a design requirement, the stress level circuit 130 may define different stress values for different stress levels. For example (but not limited to), the stress value is "0" when the stress level is "0", the stress value is "16" when the stress level is "1", and the stress value is "32" when the stress level is "2". In the frame as illustrated in FIG. 4, the stress levels of the plurality of blocks are all "0", and thus, the stress values of these blocks are adjusted to be "0" (as illustrated in FIG. 5). For the block of the second row and the second column as illustrated in FIG. 4, the stress level thereof is "1", and thus, the stress value of this block is adjusted to be "16" (as illustrated in FIG. 5). For the block of the third row and the second column as illustrated in FIG. 4, the stress level thereof is "2", and thus, the stress value of this block is adjusted to be "32" (as illustrated in FIG. 5). The stress value of each pixel is obtained by interpolating the stress values of a number (e.g., two) adjacent blocks, and the corresponding image processing is performed with the stress values of pixels.

When a certain block is converted between different stress levels, the stress values thereof may be smoothed to prevent human eyes from perceiving the pixel values. For example, in order to achieve screen smoothness, the stress value of each block may be diffused, i.e., spatially smoothed between different units. FIG. 6 is a schematic diagram illustrating a specific example of the stress levels adjusted for different blocks by diffusion. The stress level of a certain block is decreased, and the stress levels of adjacent blocks adjacent to the certain block are increased. For example, the stress level of the certain blocks are decreased from "16" and "32" to "8" and "16", and the stress levels of adjacent blocks are increased from "0" to "1". The stress value of each pixel is obtained by interpolating the stress values of a number (e.g., two) of adjacent blocks, and the corresponding image processing is performed with the stress values of pixels.

Further, for example, the stress value may be temporally smoothed. It is assumed that a stress level of a certain block is converted from "0" to "1", a stress value of this block may be gradually adjusted from "0" to "16" after a plurality of frame times. In some embodiments, the stress level circuit 130 may adjust the stress value of this block from "0" to "1" after a first frame time and then, adjust the stress value of this block from "1" to "2" after a second frame time. In the same way, the stress level circuit 130 may adjust the stress value of this block from "0" to "16" after 16 frame times.

Referring to FIG. 1 and FIG. 2, the stress level circuit 130 may serve this stress value as the stress status SS to provide to the image processing circuit 140. The image processing circuit 140 is coupled to the stress level circuit 130 to receive the stress status SS. In step S230, the image processing circuit 140 may perform related image processing according to the stress status SS and accordingly determine whether to downgrade the stress of the current block to prevent the occurrence of burn in. For example, the image processing circuit 140 may convert an original pixel value to a new pixel value according to the stress status SS, so as to downgrade the stress of the current block. Color spaces of a processed frame Fout output by the image processing circuit 140 are not limited in the present embodiment. For example, the color spaces of the processed frame Fout may include RGB, XYZ, xyY, HSV, YUV, YCbCr, Lab or other color spaces.

The image processing circuit 140 may calculate a new value of a current sub-pixel in the current block of the current frame Fcur according to an original value of the current sub-pixel in the current block of the current frame Fcur and the stress value of the current sub-pixel in the current block of the current frame Fcur. In some embodiments, the image processing circuit 140 may decrease each of a red component, a green component and a blue component of each pixel of the current block of the current frame Fcur according to the stress status SS (i.e., the stress value). For example, the image processing circuit 140 may calculate Formula 1, Formula 2 and Formula 3 below, so as to obtain a new pixel value of a current pixel. Therein, Ro, Go and Bo respectively represent a red greyscale value, a green greyscale value and a blue greyscale value in the new pixel value of the current pixel, Ri, Gi and Bi respectively represent a red greyscale value, a green greyscale value and a blue greyscale value in the original pixel value of the current pixel, Vs represents a stress value (i.e., a stress status SS) of the current pixel, and K is any real number (which is determined according to a design requirement). In some embodiments, K is greater than 0, and greater than or equal to the stress value Vs. Namely, the image processing circuit 140 may decrease all the components (i.e., the red greyscale value, the green greyscale value and the blue greyscale value) of the current pixel. That is to say, the image processing circuit 140 may dynamically downgrade the stress of the current block according to the stress status SS. Thus, the image apparatus 100 is capable of reducing the occurrence probability of burn-in.

$$Ro=[Ri*(K-Vs)]/K \quad \text{Formula 1}$$

$$Go=[Gi*(K-Vs)]/K \quad \text{Formula 2}$$

$$Bo=[Bi*(K-Vs)]/K \quad \text{Formula 3}$$

In some other embodiments, the image processing circuit 140 may decrease the blue component of each pixel of the current block of the current frame Fcur according to the stress status SS (i.e., the stress value) while maintaining the red component and the green component of each pixel of the current block of the current frame Fcur. For example, the image processing circuit 140 may calculate Formula 4, Formula 5 and Formula 6 below, so as to obtain a new pixel value of a current pixel. Namely, the image processing circuit 140 may decrease the blue component (i.e., the blue greyscale value) of the current pixel without decreasing the other color components (i.e., the red greyscale value and the green greyscale value). That is to say, the image processing circuit 140 may dynamically downgrade the stress of the current block according to the stress status SS. Thus, the image apparatus 100 is capable of reducing the occurrence probability of burn-in.

$$Ro=Ri \quad \text{Formula 4}$$

$$Go=Gi \quad \text{Formula 5}$$

$$Bo=[Bi*(K-Vs)]/K \quad \text{Formula 6}$$

In yet other embodiments, the image processing circuit 140 may decrease a value component of each pixel of the current block of the current frame Fcur according to the stress status SS (i.e., the stress value) while maintaining a hue component and a saturation component of each pixel of the current block of the current frame Fcur. For example, the image processing circuit 140 may calculate Formula 7 below, so as to obtain a new pixel value of the current pixel. Therein, Ri, Gi and Bi respectively represent the red greyscale value, the green greyscale value and the blue greyscale value in the original pixel value of the current pixel, Hi, Si and Vi respectively represent an original hue component, an original saturation component and an original value component in an HSV color space of the current pixel, Vo represents a new value component in the HSV color space, and Ro, Go and Bo respectively represent the red greyscale value, the green greyscale value and the blue greyscale value in the new pixel value of the current pixel, and Vs represents the stress value of the current pixel. Namely, the image processing circuit 140 may decrease the value component of the HSV color space without decreasing the other color components (i.e., the hue component and the saturation component). Regarding the conversion of the pixel value from a RGB color space to the HSV color space and the conversion from the HSV color space to the RGB color space, they pertain to the conventional technique and will not be repeatedly described herein.

$$\begin{bmatrix} Ri \\ Gi \\ Bi \end{bmatrix} \rightarrow \begin{bmatrix} Hi \\ Si \\ Vi \end{bmatrix} \rightarrow \begin{bmatrix} Hi \\ Si \\ Vo \end{bmatrix} \rightarrow \begin{bmatrix} Ro \\ Go \\ Bo \end{bmatrix} \quad \text{Formula 7}$$

Based on the above, the image apparatus 100 illustrated in FIG. 1 and the method of preventing burn in thereof may compare the difference between the current block in the current frame Fcur and the current block in the previous frame Fpre. The image apparatus 100 may estimate the stress status SS of the current block of the current frame Fcur according to the difference, so as to determine whether to downgrade the stress of the current block according to the stress status SS. Thus, the image apparatus 100 and the method of preventing burn in thereof are capable of effectively reducing the occurrence probability of bur in.

Figure 7:
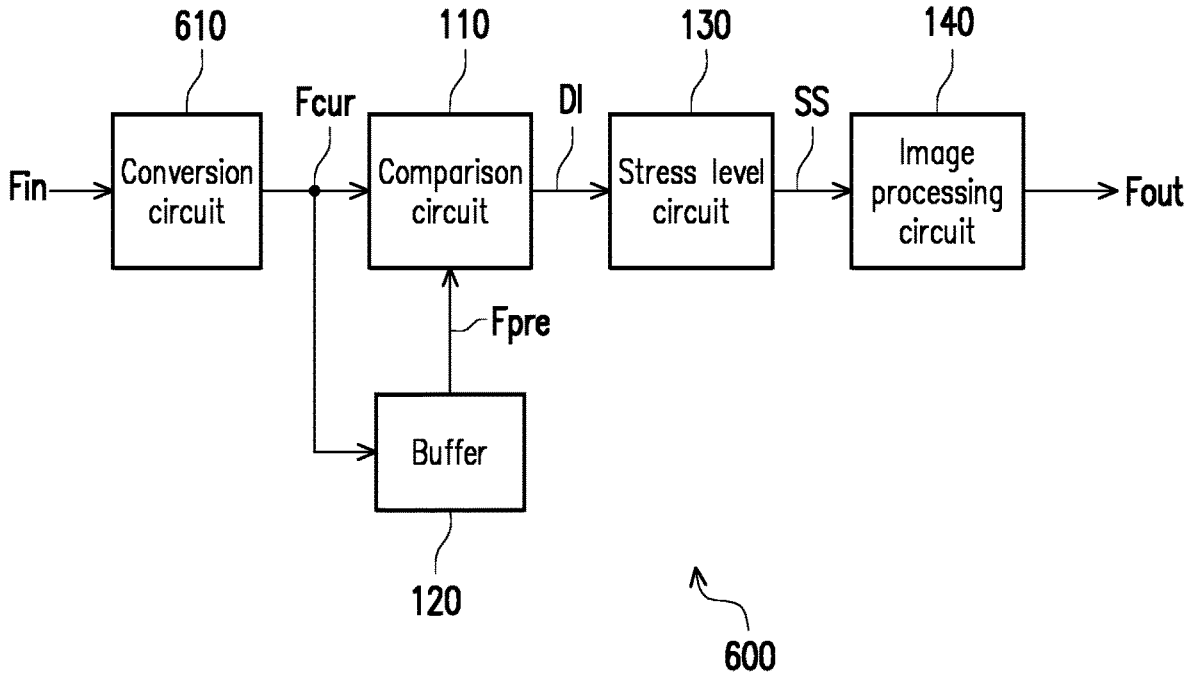
FIG. 7 is a schematic circuit block diagram illustrating an image apparatus according to another embodiment of the invention.

FIG. 7 is a schematic circuit block diagram illustrating an image apparatus 600 according to another embodiment of the invention. The image apparatus 600 includes a conversion circuit 610, a comparison circuit 110, a buffer 120, a stress level circuit 130 and an image processing circuit 140. The comparison circuit 110, the buffer 120, the stress level circuit 130 and the image processing circuit 140 illustrated in FIG. 7 may be inferred with reference to the description related to the embodiment illustrated in FIG. 1 through FIG. 5 and will not be repeated.

In the embodiment illustrated in FIG. 7, one or more converters may be disposed in the conversion circuit 610 according to design requirements. The one or more converters are configured to receive a pixel data stream Fin. The one or more converters may convert the pixel data stream Fin into the current block of the current frame Fcur and provide the current block of the current frame Fcur to the comparison circuit 110 and the buffer 120.

In some embodiments, the one or more converters of the conversion circuit 610 may convert a first color space of the pixel data stream Fin into at least one second color space of the current block in the current frame Fcur, wherein the at least one second color space is different from the first color space. The color space conversion operation of the conversion circuit 610 is not limited in the present embodiment. A plurality of converters with different conversion functions may be disposed in the conversion circuit 610, so as to convert image data into different color spaces. According to a design requirement, the conversion circuit 610 may perform the color space conversion by using a single conversion function (or connected in series with different conversion functions). For example, the conversion circuit 610 may perform the color space conversion (from the RGB color space to an XYZ color space) by using Formula 8. In Formula 8, M represents a 3*3 conversion matrix, different weights may be provided for R, G and B in the conversion matrix. For example, the conversion circuit 610 may perform the color space conversion by using Formula 8 and Formula 9. Due to the short lifetime of the blue OLED, if the designer wants to avoid the burn-in, Z (blue component) can be assigned higher weights.

$$\begin{bmatrix} X \\ Y \\ Z \end{bmatrix} = M \begin{bmatrix} R \\ G \\ B \end{bmatrix} \quad \text{Formula 8}$$

-continued $$M = \begin{bmatrix} 0.4124564 & 0.3575761 & 0.1804375 \\ 0.2126729 & 0.7151522 & 0.0721750 \\ 0.0193339 & 0.1191920 & 0.9503041 \end{bmatrix} \quad \text{Formula 9}$$

In other embodiments, the conversion circuit 610 may perform the color space conversion by using Formula 8 and/or perform the color space conversion (from an xyY color space to the XYZ color space) by using Formula 10, Formula 11 and Formula 12.

$$x = \frac{X}{X+Y+Z} \quad \text{Formula 10}$$

$$y = \frac{Y}{X+Y+Z} \quad \text{Formula 11}$$

$$Y = Y \quad \text{Formula 12}$$

It should be noted that in some embodiments, the conversion circuit 610 is not limited to only convert the two color spaces represented by Formula 8 and Formula 10-12. In other embodiments, the conversion circuit 610 may also perform the conversion from the RGB color space to the HSV color space. In brief, either a color space of an input image or a converted color space (i.e., a color space of an output image) may be a color space, such as RGB, XYZ, xyY, HSV, YUV, YCbCr, Lab, etc.

The conversion circuit 610 is not limited to only convert one into a single-color space. In other embodiments, the conversion circuit 610 may transmit the image data (i.e., the current frame Fcur) with a plurality of color spaces into the comparison circuit 110. In other embodiments, the conversion circuit 610 may perform the color space conversion by using Formula 8 and/or perform the color space conversion (from the RGB color space to the HSV color space) by using Formula 13, Formula 14 and Formula 15. Wherein, max is the largest of R, G, and B, and min is the smallest of R, G, and B.

$$H = \begin{cases} 0^\circ & \text{if } \max = \min \\ 60^\circ \times \frac{G-B}{\max - \min} + 0^\circ & \text{if } \max = R \text{ and } G \geq B \\ 60^\circ \times \frac{G-B}{\max - \min} + 360^\circ & \text{if } \max = R \text{ and } G < B \\ 60^\circ \times \frac{G-B}{\max - \min} + 120^\circ & \text{if } \max = G \\ 60^\circ \times \frac{G-B}{\max - \min} + 240^\circ & \text{if } \max = B \end{cases} \quad \text{Formula 13}$$

$$S = \begin{cases} 0 & \text{if } \max = 0 \\ \frac{\max - \min}{\max} = 1 - \frac{\min}{\max} & \text{otherwise} \end{cases} \quad \text{Formula 14}$$

$$V = \max \quad \text{Formula 15}$$

For example, the conversion circuit 610 may transmit the image data (i.e., the current frame Fcur) with the XYZ color space and the HSV color space to the comparison circuit 110. The comparison circuit 110 may obtain a count value Xcounter by comparing the difference value of the X component of the XYZ color space with a difference threshold value, obtain a count value Ycounter by comparing the difference value of the Y component of the XYZ color space with a difference threshold value, obtain a count value Zcounter by comparing the difference value of the Z component of the XYZ color space with a difference threshold value, obtain a count value Hcounter by comparing the difference value of the H component of the HSV color space with a difference threshold value, obtain a count value Scounter by comparing the difference value of the S component of the HSV color space with a difference threshold value, and obtain a count value Vcounter by comparing the difference value of the V component of the HSV color space with a difference threshold value. The comparison circuit 110 may calculate the count value $Counter_{xy}$ by using Formula 16. Wherein, a, b, c, d, e, and f are different weights for X, Y and Z components of the XYZ color space and H, S and V components of the HSV color space. The comparison circuit 110 may calculate the difference information DI corresponding to the current block of the current frame Fcur by using the count value $Counter_{xy}$.

$$Counter_{xy}=a*X_{counter}+b*Y_{counter}+c*Z_{counter}+d*H_{counter}+e*S_{counter}+f*V_{counter} \quad \text{Formula 16}$$

It should be noted that in part of the embodiments, a lifetime of a blue OLED is shorter than other color OLEDs, and if it is expected to prevent the occurrence of burn in caused by brightness decay, a Z component (i.e., a blue component) in the XYZ color space and a V component (i.e., a brightness component) in the HSV color space may be provided with higher weight values (i.e. c, f>a, b, d, e) (a, b, c, d, e, f>0). In other embodiments, the weights a, b, d, and e are zero (a, b, d, e=0), and the weights c and f are not zero (c, f>0).

In some other embodiments, the converters of the conversion circuit 610 may convert the pixel data stream Fin into the current block of the current frame Fcur according to a conversion curve. In some embodiments, the conversion circuit 610 may include a plurality of converters with different curves. According to a design requirement, the conversion circuit 610 may perform the color space conversion by using a single converter (or connected in series with different converters). For example, the conversion circuit 610 may perform the conversion by using a curve illustrated in FIG. 8, the conversion by using a curve illustrated in FIG. 9, or the conversion by using a curve illustrated in FIG. 10.

Figure 8:
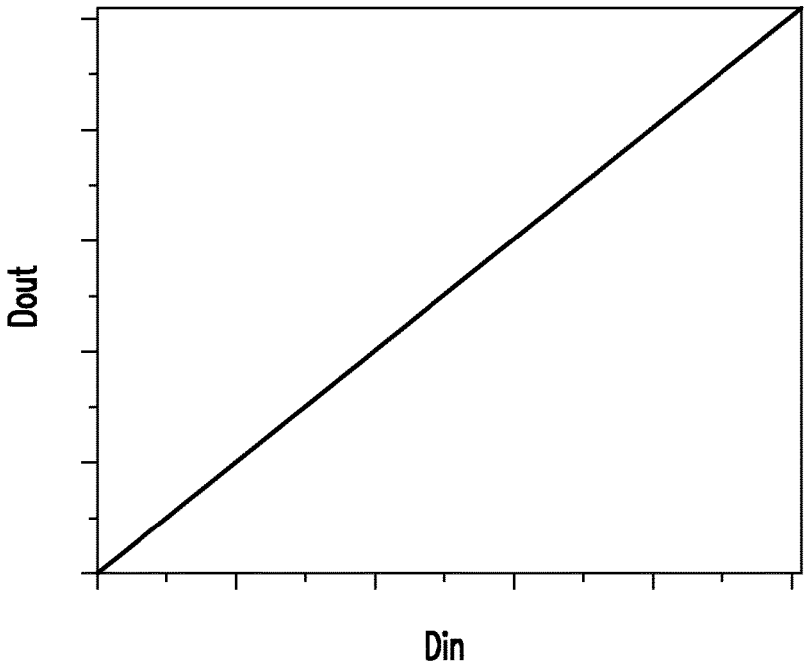
FIG. 8, FIG. 9 and FIG. 10 are schematic diagrams illustrating the conversion curves used by the conversion circuit according to different embodiments of the invention.
Figure 9:
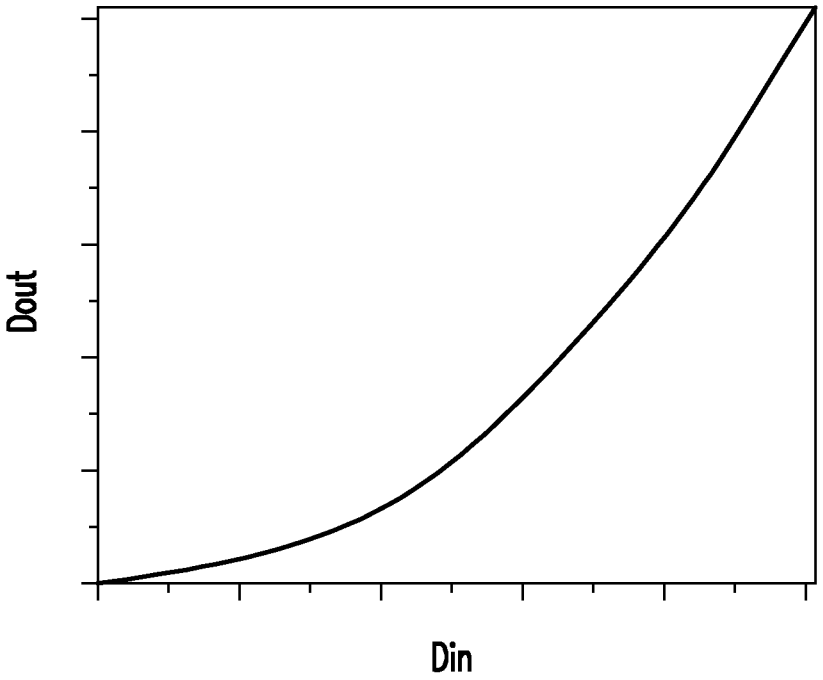
Figure 10:
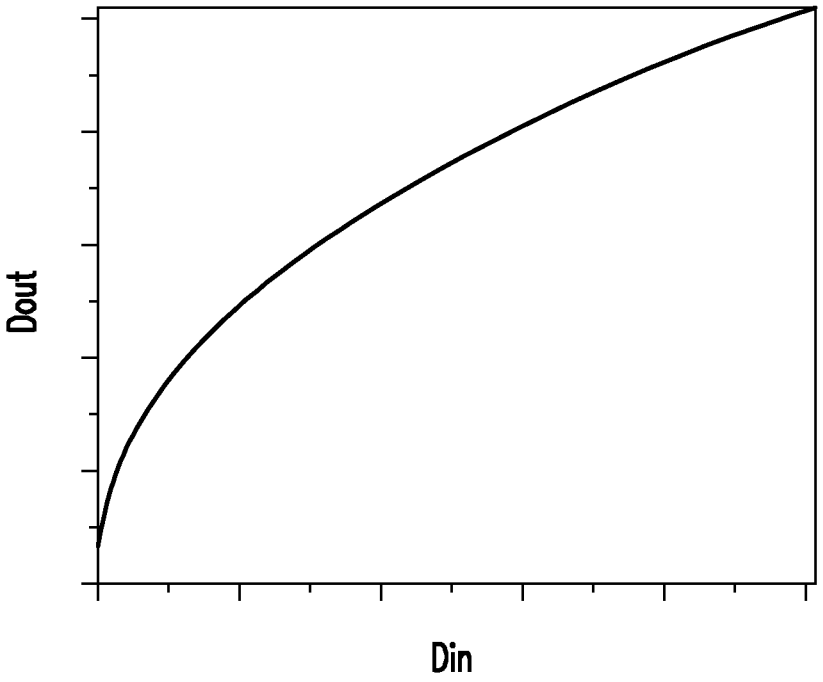

FIG. 8, FIG. 9 and FIG. 10 are schematic diagrams illustrating the conversion curves used by the conversion circuit 610 according to different embodiments of the invention. In FIG. 8, FIG. 9 and FIG. 10, the horizontal axis represents original data Din (e.g., the pixel data stream Fin illustrated in FIG. 7), and the vertical axis represents converted data Dout (e.g., the current frame Fcur illustrated in FIG. 7). The conversion circuit 610 may convert the pixel data stream Fin into the current block of the current frame Fcur according to the conversion curve illustrated in FIG. 8, FIG. 9 and/or FIG. 10.

Alternatively, in other embodiments, the curve conversion performed by the conversion circuit 610 may use conversion curves, such as a linear conversion curve, a nonlinear conversion curve, a multiple simultaneous equation conversion curve and a node interpolation conversion curve. Or furthermore, the conversion circuit 610 may convert the pixel data stream Fin into the current block of the current frame Fcur by using a formula, wherein the formula may be determined according to a design requirement. For example, the conversion circuit 610 may convert the pixel data stream Fin (i.e., the origianl data Din) into the current frame Fcur (i.e., the converted data Dout) by using Formula 17 or Formula 18. Therein, A, B and r are arbitrary real numbers determined according to a design requirement.

$$Dout = A*\left(\frac{Din}{B}\right)^{r} \quad \text{Formula 17}$$

$$Dout = A*\left(\frac{Din}{B}\right)^{1/r} \quad \text{Formula 18}$$

Based on different design demands, the blocks of the conversion circuit 610, the comparison circuit 110, the stress level circuit 130 and/or the image processing circuit 140 may be implemented in a form of hardware, firmware, software (i.e., programs) or in a combination of many of the aforementioned three forms.

In terms of the hardware form, the blocks of the conversion circuit 610, the comparison circuit 110, the stress level circuit 130 and/or the image processing circuit 140 may be implemented in a logic circuit on an integrated circuit. Related functions of the conversion circuit 610, the comparison circuit 110, the stress level circuit 130 and/or the image processing circuit 140 may be implemented in the form of hardware by utilizing hardware description languages (e.g., Verilog HDL or VHDL) or other suitable programming languages. For example, the related functions of the conversion circuit 610, the comparison circuit 110, the stress level circuit 130 and/or the image processing circuit 140 may be implemented in one or more controllers, microcontrollers, microprocessors, application-specific integrated circuits (ASICs), digital signal processors (DSPs), field programmable gate arrays (FPGAs) and/or various logic blocks, modules and circuits in other processing units.

In terms of the software form and/or the firmware form, the related functions of the conversion circuit 610, the comparison circuit 110, the stress level circuit 130 and/or the image processing circuit 140 may be implemented as programming codes. For example, the conversion circuit 610, the comparison circuit 110, the stress level circuit 130 and/or the image processing circuit 140 may be implemented by using general programming languages (e.g., C or C++) or other suitable programming languages. The programming codes may be recorded/stored in recording media, and the aforementioned recording media include, for example, a read only memory (ROM), a storage device and/or a random access memory (RAM). Additionally, the programming codes may be accessed from the recording medium and executed by a computer, a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used. In addition, the programs may be provided to the computer (or the CPU) through any transmission medium (e.g.., a communication network or radio waves). The communication network is, for example, the Internet, wired communication, wireless communication or other communication media.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An image apparatus, comprising:

a comparison circuit, configured to compare a difference between a current block in a first position in a current frame and the current block in the first position in a previous frame to obtain difference information corresponding to the difference, wherein the current block comprises at least one pixel;

a stress level circuit coupled to the comparison circuit, and the stress level circuit receiving the difference information corresponding to the current block of the current frame and configured to estimate a stress status of the current block of the current frame according to the difference information; and an image processing circuit, coupled to the stress level circuit to receive the stress status and configured to determine whether to downgrade a stress of the current block according to the stress status to prevent occurrence of burn in, wherein the stress level circuit is configured to determine a stress level of the current block of the current frame according to the difference information, the stress level circuit adjusts a stress value of the current block of the current frame to a target stress value according to the stress level and a number of frame times, and the stress level circuit serves the stress value as the stress status to provide to the image processing circuit.

2. The image apparatus according to claim 1, further comprising:

a buffer, configured to receive and temporarily store the current block of the current frame and coupled to the comparison circuit to provide the current block in the previous frame to the comparison circuit.

3. The image apparatus according to claim 1, further comprising:

at least one converter, configured to receive a pixel data stream, convert the pixel data stream into the current block of the current frame, and provide the current block of the current frame to the comparison circuit.

4. The image apparatus according to claim 3, wherein the at least one converter is configured to convert a first color space of the pixel data stream into at least one second color space of the current block in the current frame, wherein the at least one second color space is different from the first color space.

5. The image apparatus according to claim 3, wherein the at least one converter is configured to convert the pixel data stream into the current block of the current frame according to a conversion curve.

6. The image apparatus according to claim 1, wherein the current frame is entirely divided into the current block.

7. The image apparatus according to claim 1, wherein the current frame is divided into a plurality of blocks, and one of the blocks is the current block.

8. The image apparatus according to claim 7, wherein the comparison circuit is further configured to receive a temperature value and generate the difference information according to the temperature value and the difference between the current block in the current frame and the current block in the previous frame.

9. The image apparatus according to claim 7, wherein the comparison circuit is further configured to receive a humidity value and generate the difference information according to the humidity value and the difference between the current block in the current frame and the current block in the previous frame.

10. The image apparatus according to claim 1, wherein the comparison circuit calculates a first average value of a plurality of sub-pixels in the current block of the current frame and a second average value of a plurality of sub-pixels in the current block of the previous frame, the comparison circuit calculates a difference value between the first average value and the second average value, and the comparison circuit obtains the difference information corresponding to the difference between the current block in the current frame and the current block in the previous frame according to the difference value.

11. The image apparatus according to claim 10, wherein the comparison circuit is configured to obtain a first count value by comparing the difference value with at least one difference threshold value, and the comparison circuit is configured to calculate the difference information corresponding to the current block of the current frame by using the first count value.

12. The image apparatus according to claim 11, wherein the at least one difference threshold value comprises a first difference threshold value, and the comparison circuit is configured to increase the first count value when the difference value is less than or equal to the first difference threshold value.

13. The image apparatus according to claim 12, wherein the at least one difference threshold value comprises a second difference threshold value, and the comparison circuit is configured to decrease the first count value when the difference value is greater than or equal to the second difference threshold value.

14. The image apparatus according to claim 11, wherein the comparison circuit is further configured to receive a temperature value and obtain the difference information corresponding to the difference between the current block in the current frame and the current block in the previous frame according to the first count value and the temperature value.

15. The image apparatus according to claim 14, wherein the comparison circuit is configured to obtain a second count value by comparing the temperature value with a temperature threshold value, and the comparison circuit is configured to calculate the difference information corresponding to the current block of the current frame by using the first count value and the second count value.

16. The image apparatus according to claim 15, wherein the comparison circuit is configured to increase the second count value when the temperature value is greater than or equal to the temperature threshold value.

17. The image apparatus according to claim 11, wherein the comparison circuit further receives a humidity value and obtain the difference information corresponding to the difference between the current block in the cun̄ent frame and the current block in the previous frame according to the first count value and the humidity value.

18. The image apparatus according to claim 17, wherein the comparison circuit is configured to obtain a second count value by comparing the humidity value with a humidity threshold value, and the comparison circuit is configured to calculate the difference information corresponding to the current block of the current frame by using the first count value and the second count value.

19. The image apparatus according to claim 18, wherein the comparison circuit is configured to increase the second count value when the humidity value is greater than or equal to the humidity threshold value.

20. The image apparatus according to claim 1, wherein the image processing circuit is configured to calculate a new value of a current sub-pixel in the current block of the current frame according to an original value of the current sub-pixel in the current block of the current frame and the stress value of the current sub-pixel in the current block of the current frame.

21. The image apparatus according to claim 1, wherein the image processing circuit is configured to decrease each of a red component, a green component and a blue component of each pixel of the current block of the current frame according to the stress status.

22. The image apparatus according to claim 1, wherein the image processing circuit is configured to decrease a blue component of each pixel of the current block of the current frame according to the stress status while maintaining a red component and a green component of each pixel of the current block of the current frame.

23. The image apparatus according to claim 1, wherein the image processing circuit is configured to decrease a value component of each pixel of the current block of the current frame according to the stress status while maintaining a hue component and a saturation component of each pixel of the current block of the current frame.

24. A method of preventing burn in, comprising:

comparing a difference between a current block in a first position in a current frame and the current block in the first position in a previous frame by a comparison circuit to obtain difference information corresponding to the difference, wherein the current block comprises at least one pixel;

estimating a stress status of the current block of the current frame by a stress level circuit according to the difference information received by the stress level circuit; and determining whether to downgrade a stress of the current block according to the stress status by an image processing circuit to prevent occurrence of burn in, wherein the operation of estimating the stress status of the current block of the current frame comprises:

determining a stress level of the current block of the current frame according to the difference infoiiiiation by the stress level circuit;

adjusting a stress value of the current block of the current frame to a target stress value according to the stress level and a number of frame times by the stress level circuit; and serving the stress value as the stress status to provide to the image processing circuit by the stress level circuit.

25. The method of preventing burn in according to claim 24, further comprising:

temporarily storing the current block of the current frame by a buffer; and providing the current block of the current frame to the comparison circuit by the buffer.

26. The method of preventing burn in according to claim 24, further comprising:

converting a pixel data stream into the current block of the current frame to provide to the comparison circuit by the at least one converter.

27. The method of preventing burn in according to claim 26, further comprising:

converting a first color space of the pixel data stream into at least one second color space of the current block in the current frame by the at least one converter, wherein the at least one second color space is different from the first color space.

28. The method of preventing burn in according to claim 26, wherein the operation of converting the pixel data stream into the current block of the current frame comprises:

converting the pixel data stream into the current block of the current frame according to a conversion curve by the at least one converter.

29. The method of preventing burn in according to claim 24, wherein the current frame is entirely divided into the current block.

30. The method of preventing burn in according to claim 24, wherein the current frame is divided into a plurality of blocks, and one of the blocks is the current block.

31. The method of preventing burn in according to claim 30, further comprising:

receiving a temperature value by the comparison circuit; and generating the difference information according to the temperature value and the difference between the current block in the current frame and the current block in the previous frame by the comparison circuit.

32. The method of preventing burn in according to claim 30, further comprising:

receiving a humidity value by the comparison circuit; and generating the difference information according to the humidity value and the difference between the current block in the current frame and the current block in the previous frame by the comparison circuit.

33. The method of preventing burn in according to claim 24, wherein the operation of obtaining the difference information corresponding to the difference comprises:

calculating a first average value of a plurality of sub-pixels in the current block of the current frame and a second average value of a plurality of sub-pixels in the current block of the previous frame by the comparison circuit;

calculating a difference value between the first average value and the second average value by the comparison circuit; and obtaining the difference information corresponding to the difference between the current block in the current frame and the current block in the previous frame according to the difference value by the comparison circuit.

34. The method of preventing burn in according to claim 33, further comprising:

obtaining a first count value by comparing the difference value with at least one difference threshold value by the comparison circuit; and calculating the difference information corresponding to the current block of the current frame by using the first count value by the comparison circuit.

35. The method of preventing burn in according to claim 34, wherein the at least one difference threshold value comprises a first difference threshold value, and the method of preventing burn in further comprises:

increasing the first count value by the comparison circuit when the difference value is less than or equal to the first difference threshold value.

36. The method of preventing burn in according to claim 35, wherein the at least one difference threshold value comprises a second difference threshold value, and the method of preventing burn in further comprises:

decreasing the first count value by the comparison circuit when the difference value is greater than or equal to the second difference threshold value.

37. The method of preventing burn in according to claim 34, further comprising:

receiving a temperature value by the comparison circuit; and obtaining the difference information corresponding to the difference between the current block in the current frame and the current block in the previous frame according to the first count value and the temperature value by the comparison circuit.

38. The method of preventing burn in according to claim 37, further comprising:

obtaining a second count value by comparing the temperature value with a temperature threshold value by the comparison circuit; and calculating the difference information corresponding to the current block of the current frame by using the first count value and the second count value by the comparison circuit.

39. The method of preventing burn in according to claim 38, further comprising:

increasing the second count value by the comparison circuit when the temperature value is greater than or equal to the temperature threshold value.

40. The method of preventing burn in according to claim 34, further comprising:

receiving a humidity value by the comparison circuit;

obtaining the difference information corresponding to the difference between the current block in the current frame and the current block in the previous frame according to the first count value and the humidity value by the comparison circuit.

41. The method of preventing burn in according to claim 40, further comprising:

obtaining a second count value by comparing the humidity value with a humidity threshold value by the comparison circuit; and calculating the difference information corresponding to the current block of the current frame by using the first count value and the second count value by the comparison circuit.

42. The method of preventing burn in according to claim 41, further comprising:

increasing the second count value by the comparison circuit when the humidity value is greater than or equal to the humidity threshold value.

43. The method of preventing burn in according to claim 24, wherein the operation of decreasing the stress of the current block comprises:

calculating a new value of a current sub-pixel in the current block of the current frame according to an original value of the current sub-pixel in the current block of the current frame and the stress value of the current sub-pixel in the current block of the current frame by the image processing circuit.

44. The method of preventing burn in according to claim 24, further comprising:

decreasing each of a red component, a green component and a blue component of each pixel of the current block of the current frame according to the stress status by the image processing circuit.

45. The method of preventing burn in according to claim 24, further comprising:

decreasing a blue component of each pixel of the current block of the current frame according to the stress status while maintaining a red component and a green component of each pixel of the current block of the current frame by the image processing circuit.

46. The method of preventing burn in according to claim 24, further comprising:

decreasing a value component of each pixel of the current block of the current frame according to the stress status while maintaining a hue component-and a saturation component of each pixel of the current block of the current frame by the image processing circuit.

* * * * *